United States Patent [19]

Kendig et al.

[11] 4,192,245

[45] Mar. 11, 1980

[54] GUIDING MEANS FOR SELF-PROPELLED TORPEDOES

[75] Inventors: Paul M. Kendig; James M. Lawther, both of State College, Pa.; Robert G. James, Milwaukee, Wis.

[73] Assignee: The United States of America as represented by the Secretary of the Navy, Washington, D.C.

[21] Appl. No.: 735,915

[22] Filed: May 14, 1958

[51] Int. Cl.[2] ..... F42B 19/01

[52] U.S. Cl. ..... 114/23; 367/96

[58] Field of Search ..... 114/21.1, 20, 21 A, 114/23; 343/7; 102/70.2 P; 244/14; 340/3 R, 3 D

[56] References Cited

U.S. PATENT DOCUMENTS 2,409,632 10/1946 King ..... 114/21

FOREIGN PATENT DOCUMENTS 585911 2/1947 United Kingdom ..... 343/7

*Primary Examiner*—Richard A. Farley

*Attorney, Agent, or Firm*—R. S. Sciascia; Henry Hansen

EXEMPLARY CLAIM

1. In a torpedo control system the combination comprising: a tuned transducer element for projecting compressional waves of a substantially fixed frequency and having an amplitude-modulated output signal; first means for receiving said amplitude-modulated output signal and having an output signal proportional to fluctuations of transducer impedance; and second means controlled by said first means for guiding the torpedo in a predetermined manner.

10 Claims, 9 Drawing Figures

GUIDING MEANS FOR SELF-PROPELLED TORPEDOES

This invention relates to guiding means for self-propelled torpedoes and more particularly to an impedance-measuring system capable of identifying the wake of a moving vessel to cause the torpedo to be automatically guided in the proper direction to collide with the vessel.

This invention is based on the principle that certain characteristics of the wake of a moving vessel effect the motional impedance of an electroacoustic transducer to produce a fluctuation of impedance of about one percent of the average value of transducer impedance in clear water. Theoretical and experimental studies made in the development of this invention indicated that the bubble content of the wake of a moving vessel is sufficient to produce a reduction in the specific acoustic resistance of the medium which appreciably changes the electrical impedance of a resonant electroacoustic transducer and/or that the very near approach or actual contact of one or more bubbles with the face of an electroacoustic transducer has substantially the same effect on its motional impedance circle and may be used as the actuating agent in a torpedo-borne wake-sensing and control system up to speeds at least as high as 45 knots.

In accordance with the invention, there is provided in a torpedo a constant current signal source for driving a forwardly-looking transducer element having a motional impedance circle, means to detect and measure the magnitude of impedance fluctuations of the transducer comprising a bridge or adder circuit in which the average impedance of the transducer is balanced out and the bridge is maintained in approximate balance over a predetermined range of "average" impedance variations during operation whereby signals having a time constant greater than a maximum predetermined amount are substantially balanced out and short-period signals caused by a wake are passed. There is also provided means responsive to the short-period signals passed through the bridge circuit whereby only such short-period signals having a time constant greater than a minimum predetermined amount are passed. The torpedo also includes means responsive to the short-period signals intermediate said predetermined limits for actuating direction-selecting means operationally connected to the rudders of the torpedo.

By way of illustration, the transducer element may be of the magnetostrictive type mounted on a one-half wavelength aluminum waveguide extending through the extreme front surface of the shell of the head of the torpedo and so connected therewith as to provide a watertight acoustic path from the water to the transducer element. The operating frequency of the impedance panel may be controlled by a fixed frequency oscillator operating at the nominal resonant frequency of the transducer. Since the frequency tolerance of a resonant transducer is much broader than that of a fixed frequency oscillator, such a transducer can operate satisfactorily at frequencies appreciably off resonance if frequency is stable. However, fluctuations in the operating frequency will cause wide fluctuations of transducer impedance around the periphery of its impedance circle that cannot be distinguished from fluctuations caused by a wake.

To obtain a voltage proportional to transducer impedance, the transducer is driven from a constant-current source at its resonant frequency, which is to say the frequency of the fixed frequency oscillator. Variations of the transducer impedance about an average level modulates the carrier signal because of the constant current through the transducer. Consequently, the total voltage across the transducer can be considered an amplitude-modulated signal, the modulation level being a measure of the fluctuations of transducer impedance about its average value. Both the average carrier and the modulation voltage are complex voltages because of the complex nature of the impedance of the transducer.

In actual practice, the modulation voltage is proportional to fluctuation in transducer impedance and is only about one or two percent of the average carrier voltage. Consequently, to avoid saturation of the amplifier by the carrier voltage, the average carrier voltage is removed before the modulation or signal voltage is amplified. To accomplish this elimination, a bridge network is used in which the carrier, which is proportional to average transducer impedance, is balanced out by an adjustable artificially-supplied complex voltage equal in phase and amplitude to the average transducer voltage but having no modulation signal.

The output of the bridge, then, is proportional to the impedance fluctuation about the average, and as such, it is similar to a suppressed carrier modulation signal. To eliminate the necessity of employing an amplifier capable of handling the relatively high-level carrier signal, the modulation signal is suitably amplified, and thereafter the carrier is reintroduced at a constant level, and the original modulating signal is detected and used to operate a trigger circuit.

To reduce the dependency of bridge balance upon slow variations in transducer impedance, the voltage across a constant arm of the bridge is controlled by feedback voltages with a time constant much greater than the duration of any expected wake or spurious signals, these feedback voltages being proportional in phase and magnitude to the variations in average transducer impedance. This time constant, such as for example two seconds, is such that the feedback voltages are effectively direct current. The bridge, consequently, is made partially self-balancing over a wide range of both background levels and transducer impedances.

The system as described herein is capable of detecting any number of signals in sequence provided only that the bridge and associated circuitry are given enough time between signals to rebalance to background conditions. Such a condition, for example, is easily met in practice by providing suitable reversible direction-selecting means operationally associated with the trigger circuit whereby the trigger circuit orders repeated steers in opposite directions to cause the torpedo to travel in a more or less sinusoidal path into and out of the wake in the direction of the moving target. A torpedo operating in the above-described manner is generally referred to as a wake-following torpedo and is defined herein as one containing means that will cause the torpedo to execute some basic preset maneuver each time a sufficiently-strong wake signal is detected and thus is capable of making many passes at the target track or wake.

If desired, substantial simplification of the system may be obtained without any substantial reduction in the hit probability of the torpedo by providing direction-selecting means for causing the torpedo to merely turn at a fixed rate in a preset direction, i.e., the direction of travel of the moving target. Such a torpedo is generally referred to as a wake-detecting torpedo and is defined herein as one aimed as a straight-running torpedo, used either singly or in salvo. If the torpedo should miss astern of the target on the straight run and thus receive a wake signal, it will make an additional pass at the target. Optimum hit-probability of such a torpedo which compares quite favorably with the most desirable one may be substantially obtained when the torpedo has a turning radius of from about 75 to 100 yards and a speed ratio (torpedo-to-target) of greater than three when the torpedo is fired in such a direction as to cross the wake at angles in the vicinity of 90 degrees and within one target length astern of the target or moving vessel.

It is, accordingly, an object of the invention to provide a wake-homing system based upon detectable variation in the impedance, rather than upon the acoustic sensitivity, of a transducer.

It is another object of the invention to utilize an ultrasonic impedance measuring system for high-speed torpedoes to provide a wake-following or wake-detecting torpedo.

It is another object of the invention to provide an impedance-measuring system in high-speed torpedoes for automatically controlling the direction of travel of the torpedo wherein the effect of the wake of a moving vessel on the motional impedance of an ultrasonic transducer is the actuating agent.

Still another object of the invention is the provision in a high-speed torpedo of a wake-sensitive system based upon detectable variations in the impedance of a transducer that will substantially ignore all other signals or conditions other than the effect of a wake upon the transducer.

These and other objects and features of the invention, together with their incident advantages, will be more readily understood and appreciated from the following detailed description of the preferred embodiment thereof selected for purposes of illustration and shown in the accompanying drawings, in which.

Figure 5:
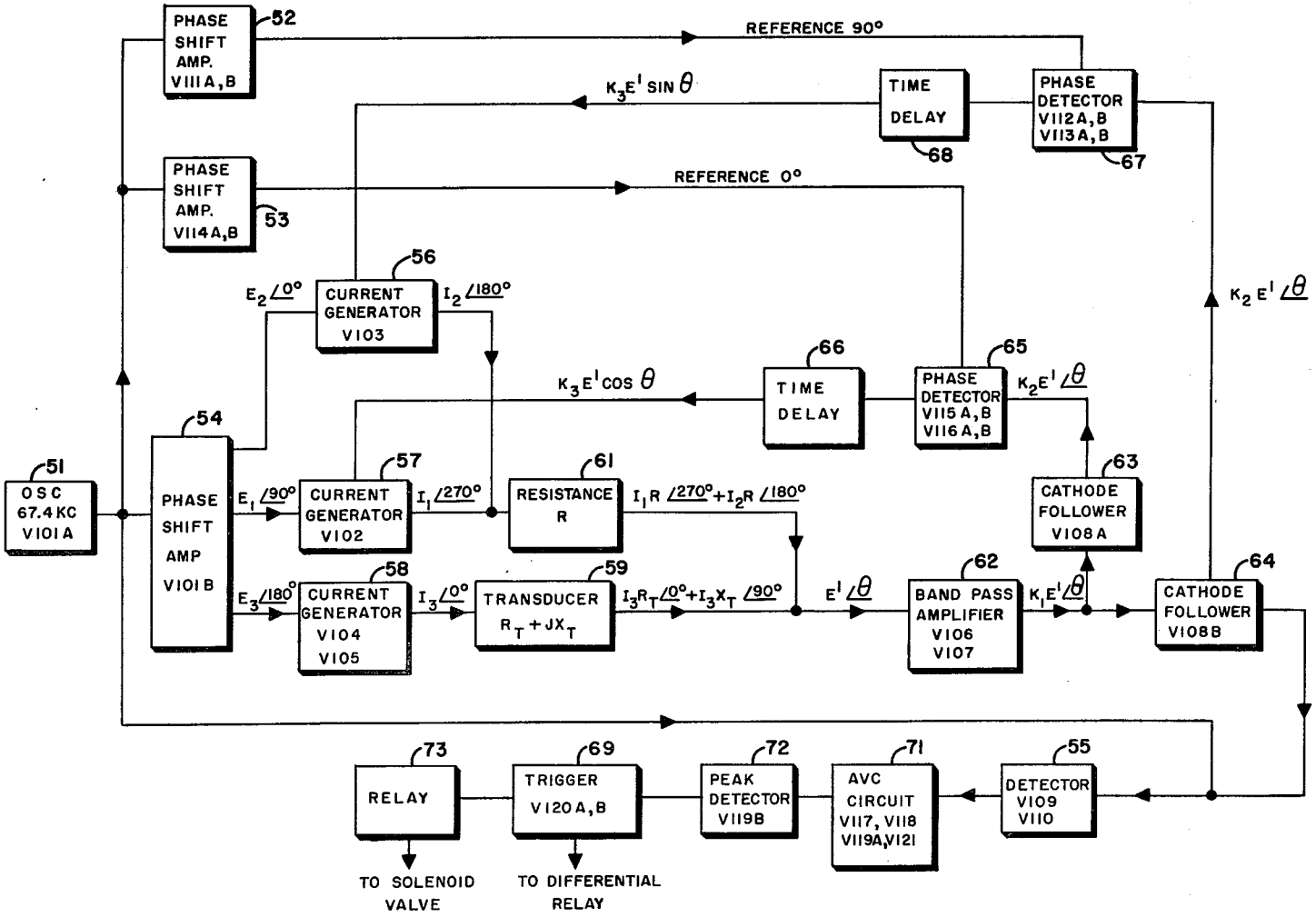
FIG. 5 is a block diagram of the control panel for processing the output signal of the transducer.
Figure 7:
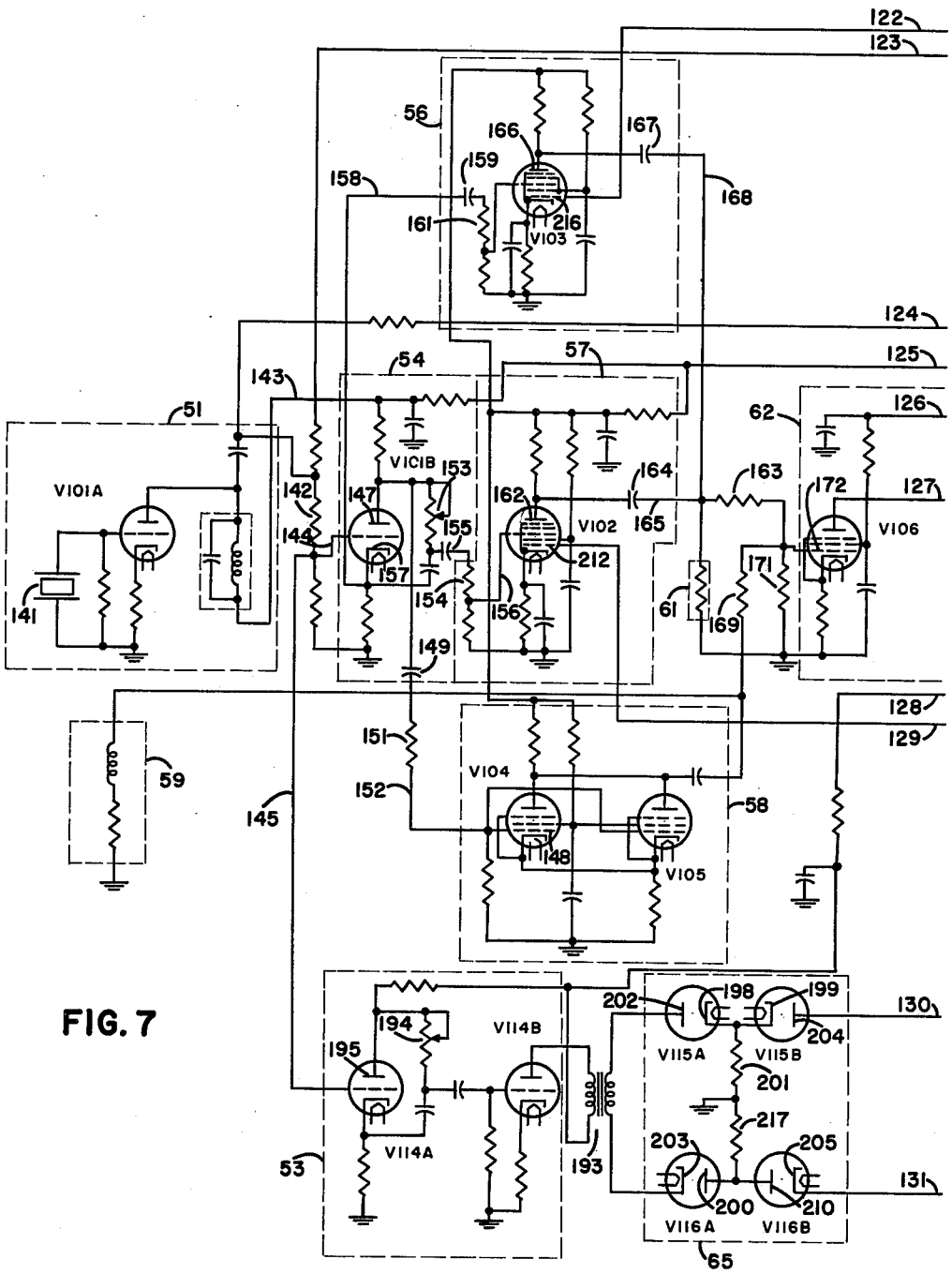
Figure 8:
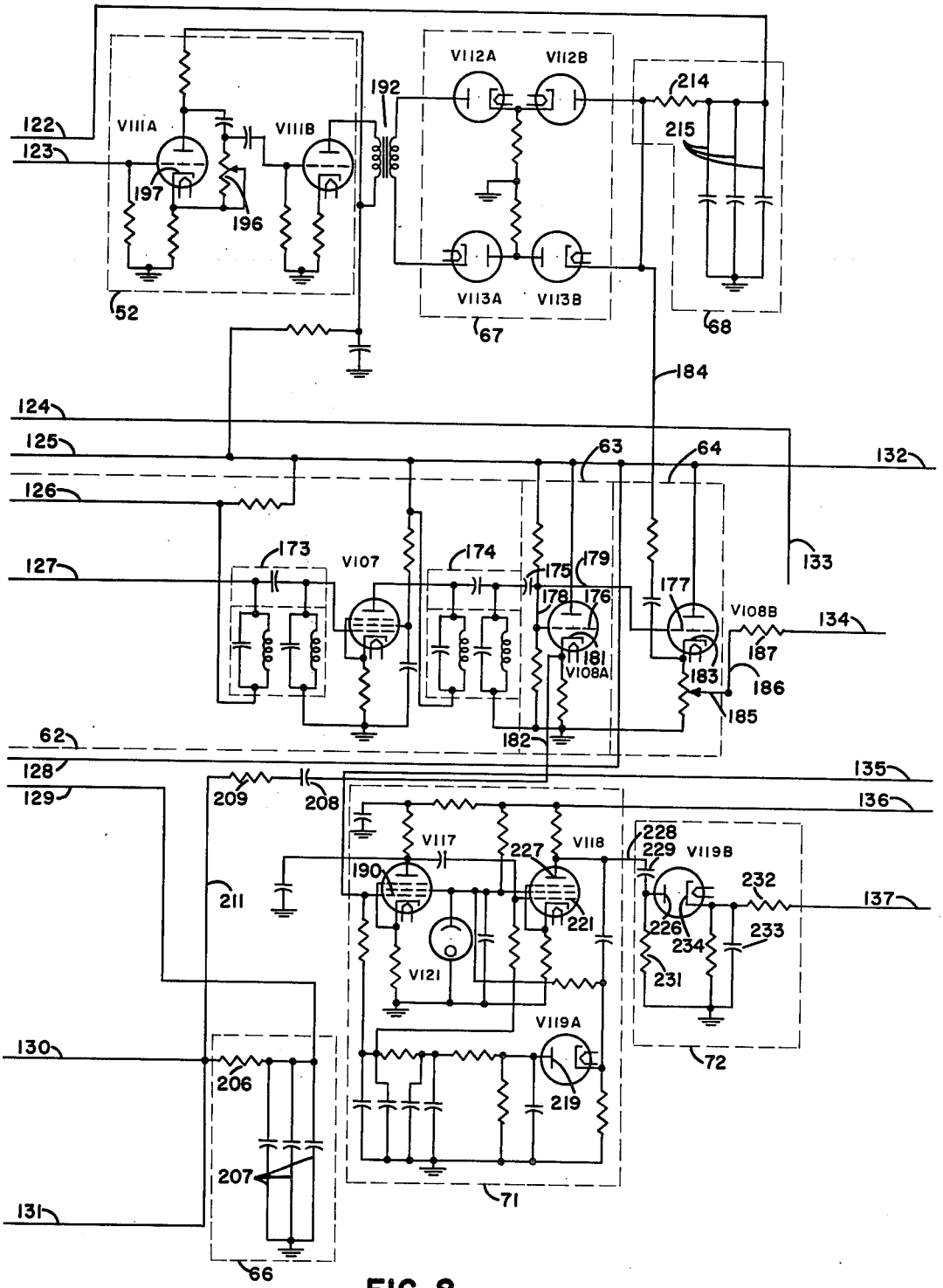
Figure 9:
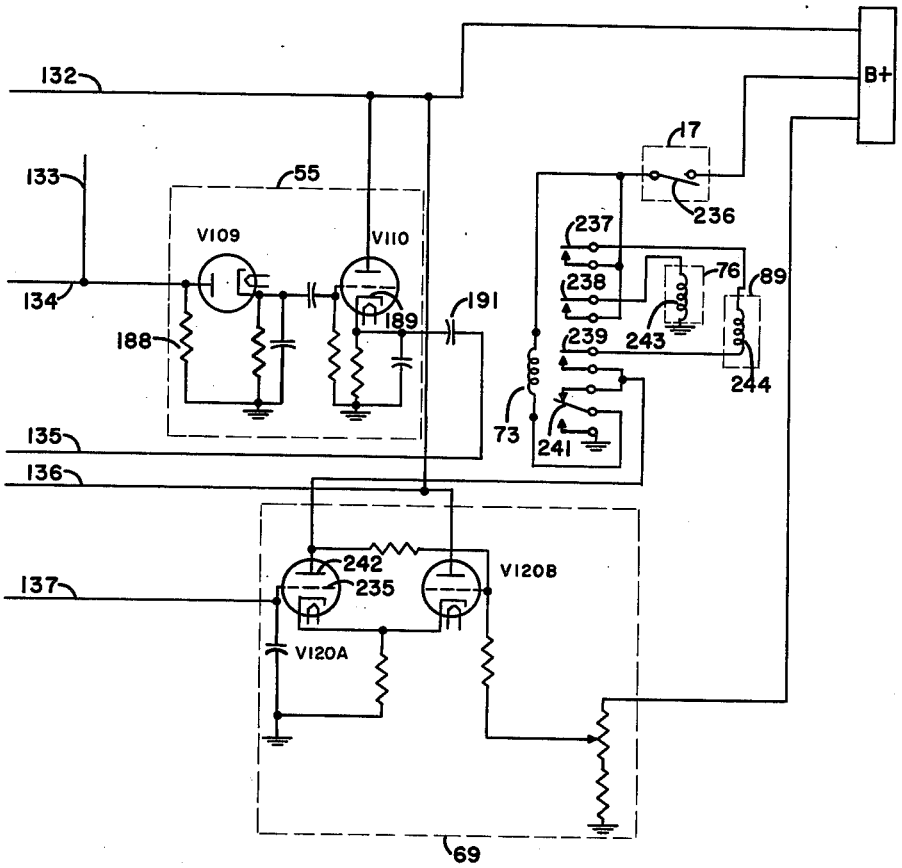

FIGS. 7, 8, and 9, when consecutively placed side by side, form a schematic diagram of the control panel shown in FIG. 5.

Figure 1:
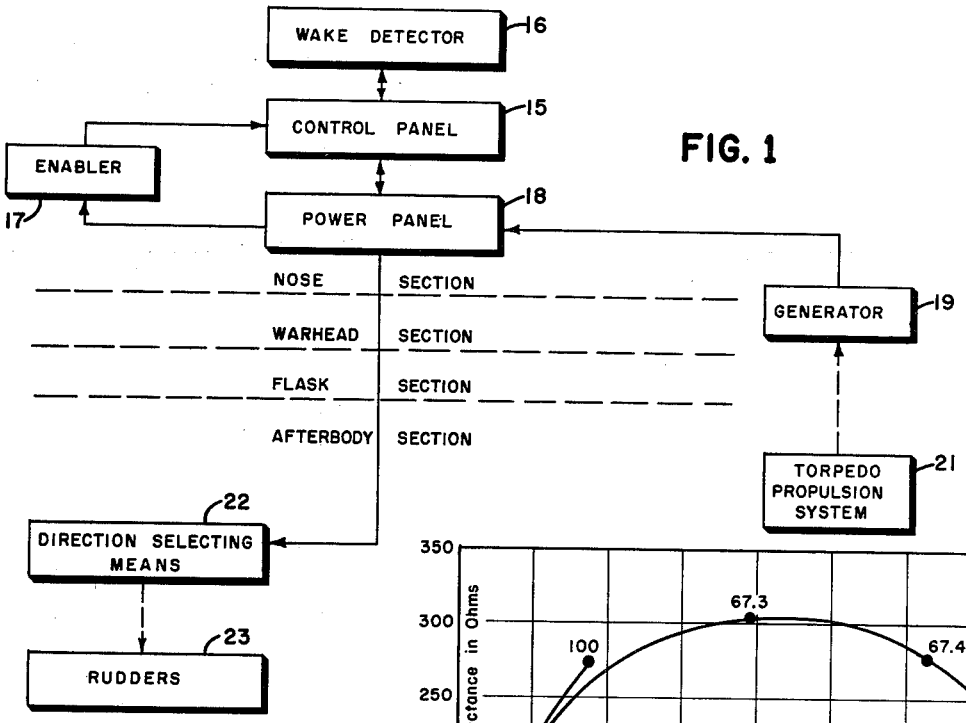
FIG. 1 is a block diagram showing the functional components of the invention with relation to the sections of a torpedo. Mechanical linkages are shown by dashed lines and electrical connections are shown by solid lines, the direction of information transfer being shown by the arrowheads on each line.

The functional components of the system as shown in FIG. 1 are comprised and arranged such that there is located in the nose section of a torpedo a control panel 15 electrically associated with wake-detecting means 16 for supplying signals to and processing signals from the wake-detecting means 16, an enabler circuit 17, and a power supply panel 18 for supplying the necessary AC and DC voltages to the system. The enabler circuit 17 is provided to prevent actuation of the control panel 15 for a predetermined time after the torpedo has been fired. Arranged and disposed in the afterbody of the torpedo is an alternating-current generator 19 driven by the torpedo propulsion system 21 for supplying power to the power supply panel 18, and disposed also in the afterbody are direction-selecting means 22 actuated by the control panel 15 for actuating the rudders 23 to control the torpedo.

Figure 2:
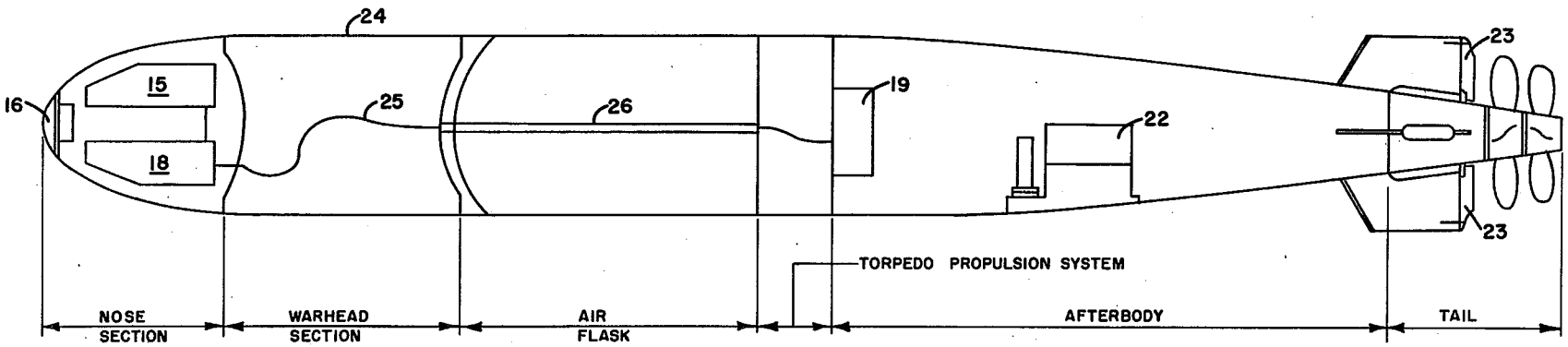
FIG. 2 is a diagramatic representation of a torpedo showing the approximate location and arrangement of the functional components shown in FIG. 1.

FIG. 2 shows the approximate arrangement in a steam torpedo 24 of the functional components referred to generally hereinabove wherein the electrical connections 25 between the components in the nose section and the afterbody are carried in a tube 26 passing through the airflask. The self-contained power supply may be comprised of an alternating-current generator 19 driven by the torpedo propulsion system 21 and a conventional electronic power supply panel 18 to convert the generator output to approximate AC and DC voltages as may be required or desired. With minor modifications the system may be installed in a like manner in electrical or other types of torpedoes.

Figure 3:
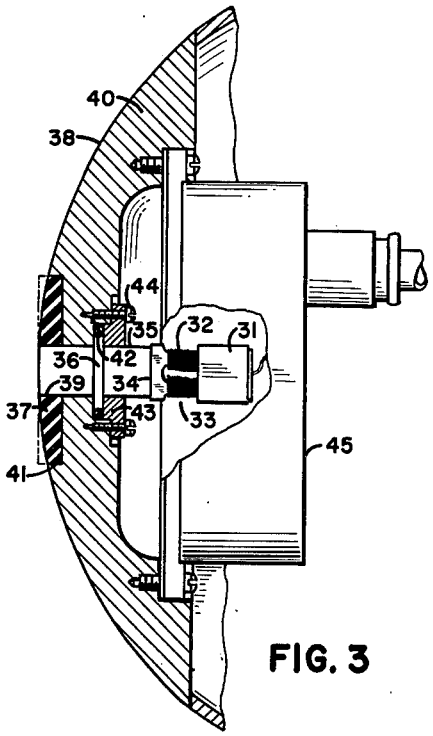
FIG. 3 is a side elevation, partially in section, of the wake-detecting apparatus comprised of a magnetostrictive transducer mounted on a waveguide to provide a watertight acoustic path through the shell of the head of the torpedo to the transducer.

With reference now to FIG. 3 there is shown a laminated magnetostrictive type transducer 31 having a suitable number of turns of wire 32 wound in series on two oppositely disposed legs forming the middle portion 33 of the transducer 31. The transducer is cemented or bonded at its working face 34 to a half-wave length waveguide 35 having an outwardly-extending annular ring 36 formed at the centerpoint of the waveguide 35. A rubber pad 37, faired to conform to the outer surface 38 of the torpedo shell 40, is cemented to the forward end portion 39 of the waveguide and cemented at its outer periphery 41 to the torpedo shell 40. An O-ring 42 encircling the outwardly-extending ring 36 provides a watertight seal between the ring 36 and the torpedo shell 40 and a retaining plate 43 fixedly attached to the torpedo shell 40 as by screws 44 or the like holds the entire assembly in rigid transverse relation with respect to the torpedo shell 40. Disposed rearwardly of and around the transducer element 31 is a cover 45 removably attached to the torpedo shell 40 to exclude moisture, foreign matter and the like from the transducer element 31. With regard to the construction and location of the wake-detector means, it is pertinent to note that there is an accepted theory that near the centerline at the nose of a torpedo there exists a "dead space" within which water flow is significantly different from that around the rest of the torpedo shell. On the basis of this theory, it was previously believed reasonable to conclude that wake bubbles are washed around the nose along flow lines sufficiently far from a transducer mounted flush at the centerline to prevent detection. It has been found, however, contrary to the abovementioned theory, that a flush-mounted transducer as described hereinabove and located on the centerline at the nose of the torpedo will operate successfully and hence that the dead region is neither complete nor a governing factor in the operation of the system.

Figure 4:
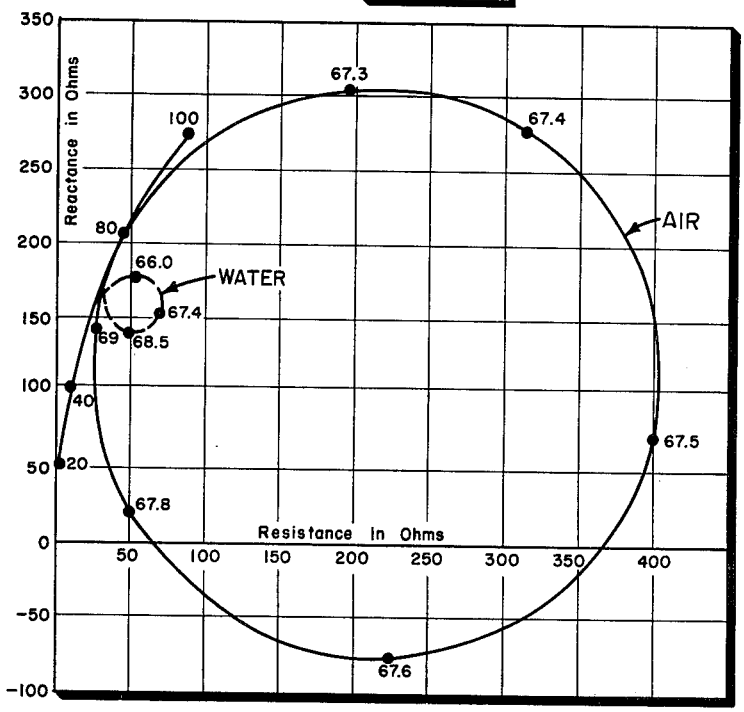
FIG. 4 is a curve diagram showing typical impedance circles of a suitable transducer as a function of frequency when the transducer is in air and when the transducer is in water, the impedance of the transducer being substantially the same in both air and water at all frequencies except those close to resonance.

Although there has been shown and described a specific and preferred embodiment of the wake-detector means, it is to be understood that any transducer having typical air and water impedance circles comparable to that as shown for purposes of illustration in FIG. 4 may be substituted for the magnetostrictive transducer element shown and described herein. Further, if desired, the wake detector need not be flush-mounted on the centerline of the torpedo. Still further, the transducer element may form part of a conventional array and serve the dual function of performing its regular functions in the array in addition to acting as an impedance sensitive device to detect the crossing of a ship's wake or the wake of a moving vessel in accordance with the invention as shown and described herein.

Referring now to FIG. 5, the operating frequency of the control panel is controlled by a fixed frequency oscillator 51 having an operating frequency approximately the same as the resonant frequency of the transducer in water such as for example 67.4 kc.

Since fluctuations in operating frequencies can cause wide fluctuations of transducer impedance around the periphery of its impedance circle (see FIG. 4) that cannot be distinguished from fluctuation caused by encountering a wake it is essential that the operating frequency be substantially fixed.

Further, as pointed out hereinbefore, since the modulation voltage is proportional to fluctuation in transducer impedance and as a practical matter is only about one percent to two percent of the average carrier voltage, it is necessary to remove the average carrier voltage before the modulation or signal voltage is amplified to prevent saturation of the amplifier by the carrier voltage. The elimination of the carrier voltage is accomplished by a bridge network in which the carrier voltage, which is proportional to "average" transducer impedance, is balanced out by an artificially-supplied complex voltage equal im amplitude but 180 degrees out of phase with the average transducer voltage but having no modulation signal. In this manner, the output of the bridge is made proportional to the impedance fluctuation about the average and is similar to a suppressed carrier modulation signal.

The carrier frequency or output of the fixed frequency oscillator 51 is applied to phase shift amplifiers 52, 53, 54 and to the detector 55. The output signals of the phase shift amplifier 54 which are three voltages, $E_1$, $E_2$, and $E_3$ of respectively phases 90°, 0°, and 180° relative to that of the output signal of the oscillator 51, are supplied to three adjustable constant current generators 57, 56, 58. The adjustable constant current generators 57, 56, 58 are of the constant-current type as far as their load impedance is concerned and are adapted to supply three currents $I_1$, $I_2$, and $I_3$ of respectively phases 270°, 180°, and 0° relative to the oscillator reference signal which is the reference for all voltages and currents referred to hereinafter. The transducer 59 is driven by the output current $I_3\angle 0°$ of current generator 58, and due to the complex impedance of the transducer 59, the voltage across it has the form $I_3R_T\angle 0° + I_3X_T\angle 90°$ where $R_T$ and $X_T$ are respectively the resistive and reactive components of the transducer impedance. Since the transducer 59 is driven by a constant current having a fixed phase angle it may now be obvious that variations of the voltage appearing across the transducer 59 will be directly proportional to the variations of transducer impedance and that under steady state conditions, a voltage having a substantially constant amplitude will appear across the transducer. The output signals of the current generators 56 and 57 are combined and supplied to a fixed and substantially pure resistor 61 forming a part of the bridge or adder circuit. The current $I_1$ and $I_2$ through the resistor 61 produces a voltage across the resistor 61 having the form $I_1R\angle 270° + I_2R\angle 180°$ that, when added to the voltage across the transducer, produces a voltage $E' = I_2R\angle 180° + I_3R_T\angle 0° + I_1R\angle 270° + I_3X_T\angle 90°$. It may now be obvious that the voltage appearing across the fixed resistor 61 is and/or may be adjusted to be substantially opposite in phase and equal in amplitude to the steady state voltage appearing across the transducer 59 and that when they are combined as described hereinabove they will cancel each other. When so combined, the output signal of the bridge is a voltage $E'\angle\theta$. Under ideal balance conditions, the voltage E' will equal zero and for any condition other than that of perfect balance, an error voltage E' having phase angle $\theta$ will be presented to the bandpass amplifier 62.

Figure 6:
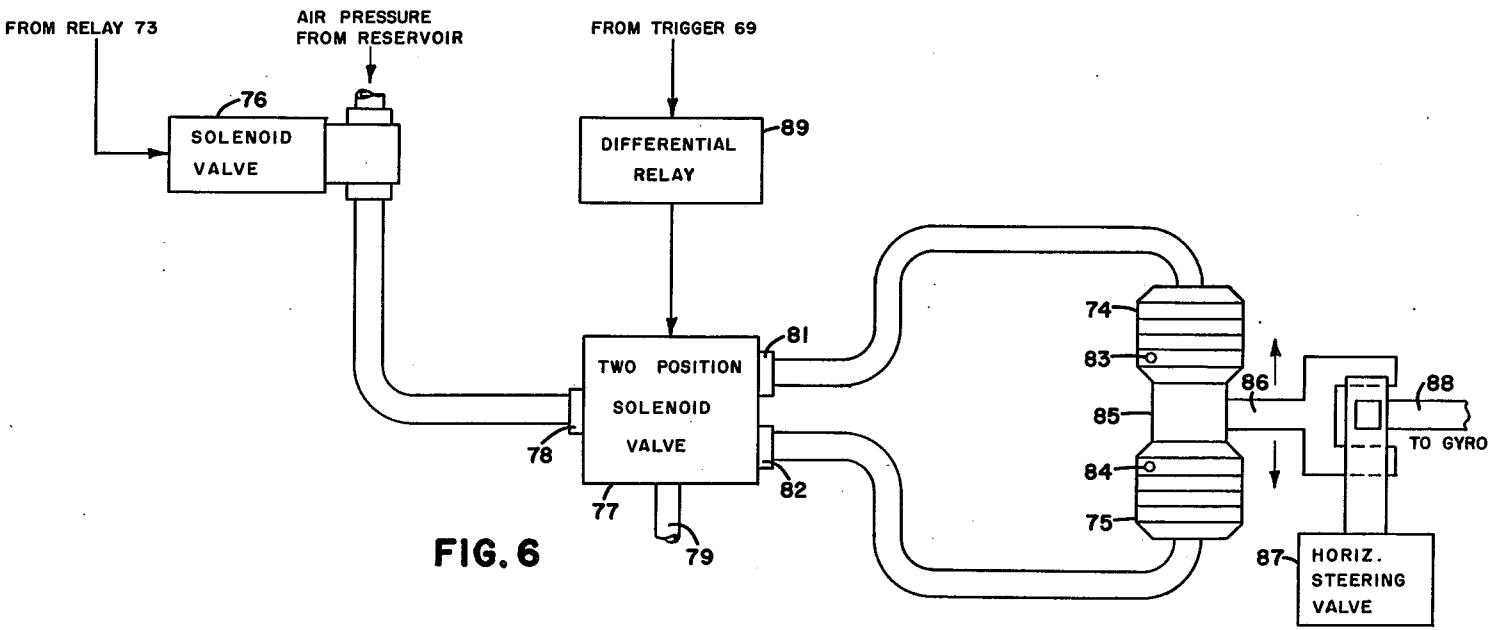
FIG. 6 is a block diagram, partially diagramatic, of a reversible pneumatic gyro override and steering selector system actuated by the control panel.

To reduce the dependence of bridge balance on slow variations in transducer impedance, the voltage across the fixed arm of the bridge is controlled by feedback voltages with a time constant much greater than the duration of any expected wake or spurious signal, these feedback voltages being proportional in phase and magnitude to the variations of average transducer impedance. This time constant, such as for example, two seconds, is such that the feedback voltages are effectively direct current. The bridge, consequently, is made partially self-balancing over a fairly wide range of both background levels and transducer impedances. The output voltage $K_1E'\angle\theta$ of the band pass amplifier 62 is supplied to the cathode followers 63 and 64 having substantially identical output voltages $K_2E'\angle\theta$. The output voltage $K_2E'\angle\theta$ of the cathode follower 63 is supplied to a phase sensitive detector 65, the operation of which is controlled by the phase shift amplifier 53 having an output or feedback reference signal at about zero degrees. The output signal of the phase sensitive detector 65 is passed through a time delay circuit 66 having a time constant of about two seconds and an output voltage $K_3E'$ cosine $\theta$ which is supplied to and which controls the output current of the current generator 57. The output voltage $K_2E'\angle\theta$ of the other cathode follower 64 is supplied to a phase sensitive detector 67 the operation of which is controlled by the phase shift amplifier 52 having an output or feedback reference signal at an angle of about ninety degrees. The output signal of the phase sensitive detector 67 is passed through a time delay circuit 68 having a time constant equal to that of the time delay circuit 66 and an output voltage $K_3E'$ sine $\theta$ which is supplied to and which controls the output current $I_2\angle 180°$ of the current generator 56. If the disturbance or error voltage E' is of sufficiently long duration, which is to say, greater than two seconds, the currents $I_1$ and $I_2$ will be altered by means of the feedback loops described hereinabove in such a way as to reduce E'. Duration of disturbance voltage E' greater than two seconds may be substantially attributed to either background level, changes in transducer impedance level, or both. It may now be apparent that due to the feedback loop, slow changes in voltage E' due to background or variations in transducer impedance level are effectively suppressed and that the voltage $K_2E'\angle\theta$ supplied to the detector 55 will be representative of changes in transducer impedance due to exterior conditions similar to that present in and only when the wake of a moving vessel is encountered. Since the voltage $K_2E'\angle\theta$ supplied to detector 55 may, in addition to a wake signature, also contain spurious signals, the following described circuitry is provided to suppress such signals and pass only those signals characteristic of that attributable to crossing a ship's wake. After suitable amplification of the modulation signal $E'\angle\theta$ by the amplifier 62, the carrier is reintroduced at a constant level, and the modulating signal is detected and used to operate a trigger circuit more fully described hereinafter. This arrangement eliminates the necessity of employing an amplifier capable of handling the relatively high level carrier signal. More specifically, the carrier signal of the fixed frequency oscillator 51 is reintroduced to the amplified error voltage $K_2E'\angle\theta$ supplied to detector 55 and the resultant signal is detected by means of the detector 55. The output signal of the detector is a low frequency signal having a frequency less than the band pass of the amplifier 62, such as for example, less than 2 kc. In order to accomodate the variable range of background fluctuation levels without actuating the trigger circuit 69 on background, there is provided an AVC or build up rate measuring circuit 71 having a dynamic range of about 25 db and a time constant such that approximately two seconds are required for the circuit to adjust to a step input. The AVC circuit 71 is adapted to pass only such signals having a time constant of two seconds or more and a signal-to-noise ratio of about 6 db or more, which signal is supplied to a peak detector circuit 72 adapted to have an output signal only when the input signal has a time constant of about 0.2 seconds or more. The output signal of the peak detector circuit 72 is applied to the trigger circuit 69, such as for example a Schmitt trigger circuit, which actuates a relay 73 to cause actuation of the steering mechanism in the afterbody of the torpedo more fully described hereinafter. By way of example and illustration, there is shown in block diagram form in FIG. 6 a pneumatic steering-selector system and gyro override actuated by the relay 73 and trigger circuit 69 shown in FIG. 5. The steering-selector system as shown in FIG. 6 consists basically of a pair of opposing bellows linked to a horizontal steering valve with enough play to permit the valve to operate freely under control of the linkage from the gyro pallet mechanism (not shown) when no air pressure is applied to either bellows. However, air pressure in either bellows causes the horizontal steering valve to be thrown in one direction or the other with such force that the gyro linkage cannot overcome the steering order, and the steering engine remains in the ordered position until air is removed from the bellows. Due to the flexibility of the linkage from the pallet mechanism, no damage is caused by the forced biasing of the bellows.

With reference specifically now to FIG. 6 compressed air from a reservoir (not shown) is alternately supplied to two oppositely disposed bellows 74 and 75 through a normally closed control solenoid valve 76 and a two-way steering-selector solenoid valve 77 disposed between the control valve 76 and the bellows 74 and 75. The steering-selector valve 77 may be a conventional two position solenoid valve having an inlet port 78 connected to the control valve 76, an exhaust or bleeder port 79, and two outlet ports 81 and 82 connected respectively to the bellows 74 and 75 and constructed and adapted in the conventional manner such that when the steering-selector valve 77 is in one position air pressure is supplied, for example, to bellows 74, and bellows 75 is connected to exhaust through the bleeder port 79 and when the steering-selector valve 77 is in another position, air pressure is supplied to bellows 75 and bellows 74 is connected to exhaust through the bleeder port 79. To prevent the leakage of air pressure from biasing one or the other of the bellows 74 and 75, small exhaust ports 83 and 84 may be provided respectively in each bellows 74 and 75, each port 83 and 84 having a diameter such that the leakage of air pressure therethrough will not affect the operation of the bellows by the steering-selector valve 77. A center element 85 having an outwardly extending fork 86 is disposed between the bellows 74 and 75 and fixedly attached thereto whereby the fork 86 may be operationally connected to a conventional horizontal steering valve 87 normally actuated by a linkage 88 of the gyro pallet mechanism (not shown). A conventional relay 89, for example of the differential or two position type controls the operation of the steering-selector valve 77 such that the steering-selector valve is caused to alternate from a first position and second position as described hereinabove to secure a wake-following trajectory. Obviously, if a wake-detecting trajectory is desired, the steering-selector valve 77 need be thrown only once in a pre-selectable direction as discussed hereinbefore.

Actuation of the trigger circuit 69 locks in relay 73 thereby continuously supplying current to the solenoid of the control valve 76 and pulling it to an open position. Actuation of the trigger circuit 69 simultaneously supplies current to relay 89 which in turn causes the steering-selector valve 77 to be initially actuated in the proper direction to supply air pressure to the proper bellows to cause the torpedo to be steered in the direction of the target. Thereafter, each time the torpedo crosses the wake, operation of the trigger circuit 69 reverses relay 89 and thereby reverses the position of the steering-selector valve 77 which in turn causes the torpedo to make a plurality of passes at the wake and strike the target.

Reference will now be made to FIGS. 7, 8, and 9, which show in detail the contents of the blocks of FIG. 5 wherein the majority of components comprising each block are enclosed by broken lines which are identified by the numerals used in FIG. 5 and tube identifications are indicated to conform with FIG. 5 to facilitate reference to and from FIGS. 7, 8 and 9 and the discussion following hereinbelow. The frequency of the conventional fixed frequency oscillator 51 is accurately controlled by a crystal 141 tuned to the nominal resonant frequency of the transducer 59. The output signal of the oscillator 51 is supplied to a voltage divider 142 by conductor 143 and from the voltage divider as follows: to the phase shift amplifier 54 by conductor 144; to the phase shift amplifier 53 by conductor 145; and to the phase shift amplifier 52 by conductor 123. With reference now to phase shift amplifier 54, output voltage $E_3\angle 180°$ is supplied from the plate 147 of V101B to plate V104 through capacitor 149, resistor 151 and conductor 152; output voltage $E_1\angle 90°$ is supplied from the plate 147 of V101B through resistors 153 and 154, capacitor 155 and conductor 156 to the current generator 57; and output voltage $E_2\angle 0°$ is supplied from the cathode 157 of V101A through conductor 158, capacitor 159, and resistor 161 to the current generator 56. Current generator 58 is comprised of two tubes V104 and V105 connected in parallel for supplying a fixed and constant current $I_3\angle 0°$ to the transducer 59. Current generator 56 is comprised of tube V103 and is substantially similar in construction to current generator 57. Current $I_1\angle 270°$ supplied from the plate 162 of V102 to the common connection of resistors 61 and 63 through capacitor 164 and conductor 165. Current $I_2\angle 180°$ is supplied from the plate 166 of V103 to the common connection of resistors 61 and 163 through capacitor 167 and conductor 168. Resistor 61 is connected to ground and resistors 169 and 171 are connected to resistor 163, resistor 171 being grounded. The transducer 59 is effectively connected between resistors 61 and 169 such that its grounded terminal is common with the grounded terminal of resistor 61. The output signal of the above described arrangement of resistors is supplied from the common terminal of resistors 163, 169 and 171 to the control grid 172 of V106.

The above described network may be considered a bridge network wherein all of the circuitry supplying currents $I_1\angle 270°+I_2\angle 180°$ is one leg, the transducer 59 another leg, resistors 163 and 169 the remaining two legs, and resistors 61 and 171 are connected to opposite terminals of the bridge and to ground; or, alternately, the network may be considered an adder network wherein currents $I_1\angle 270°+I_2\angle 180°$ are attenuated through resistor 163, the output current of the transducer 59 is attenuated through resistor 171, both signals being added across resistor 171 and supplied to the control grid 172 of V106.

The amplifier 62 is a conventional band-pass amplifier having a pass band of about 2 kc and is comprised of V106, band-pass filter 173, V107 and band-pass filter 174. Two band-pass filters are provided to peak the pass band. The output signal of the band-pass amplifier 62 is supplied through capacitor 175 to respectively the control grids 176 and 177 of V108A and V108B by conductors 178 and 179. V108A and V108B are similar cathode followers to provide isolation between the plate circuit of V107 and any following stages.

Voltage $K_2E'\angle\theta$ is supplied from the cathode 181 of V108A to the phase detector 65 by conductor 182 and voltage $K_2E'\angle\theta$ supplied from the cathode 183 of V108B to the phase detector 67 by conductor 184 and voltage $K_2E'\angle\theta$ is supplied to detector 55 by potentiometer arm 185, conductor 186, and resistors 187 and 188. It is desirable that the output signal, of the cathode follower 64 to detector 55 be adjustable to allow the selection of an error signal compatible with the trigger level built into detector 55.

Detector 55 is comprised of a conventional diode detector V109 feeding a cathode follower V110 for isolating the detector 55. The AC output signal of the detector 55 is taken from the cathode 189 of V110 and supplied through capacitor 191 and conductor 135 to the control grid 190 of V117.

Phase shift amplifiers 52 and 53 are of conventional design for providing two separate output signals having a phase with respect to their identical input signals (the output signal of the oscillator 51) of respectively 90° and 0° which are supplied respectively to transformers 192 and 193. Phase shift amplifiers 52 and 53 are comprised of substantially identical dual triodes V111 and V114 and associated circuitry with the exception of the capacitor and variable resistor connected in series between the plate and cathode of V111A and V1114A. The provision of the variable resistor connection 194 to the plate 195 of V114A provides an output signal to transformer 193 at 0° (in phase with the reference signal) and the provision of a variable resistor connection 196 to the cathode 197 of V111A provides an output signal to transformer 192 at 90°. Variable resistors 194 and 196 allow exact adjustment of the phase of the output signals of the phase shift amplifiers 52 and 53.

Phase detector 65 is a double-sided, phase-sensitive detector of conventional design wherein the cathodes 198 and 199 of V115A and V115B are connected together and to ground through a resistor 201; the plates 200 and 210 of V116A and V116B are connected together and to ground through a resistor 217; the plate 202 of V115A and the cathode 203 of V116A are connected to the terminals of the secondary of transformer 193; and the plate 204 of V115B and the cathode 205 of V116B are connected together and to the time delay circuit 66 comprised of a resistor 206 and capacitors 207 forming an RC circuit having a time constant of about 2 seconds. Voltage $K_2E'\angle\theta$ is supplied from the cathode 181 of V108A through capacitor 208, resistor 209 and conductor 211 to the detector side of resistor 206 forming a part of the time delay circuit 66. The voltage $K_3E'\sin\theta$ is a DC voltage for controlling the operation of the current generator 57 and is supplied from the time delay circuit 66 to the control grid 212 of V102 by conductor 129. As may now be apparent, the comparison of the feedback reference voltage at 0° with voltage $K_2E'\angle\theta$ in detector 65 results in an output voltage $K_3E'\cos\theta$ that varies the amplitude of current $I_1\angle 270°$ of current generator 57 in accordance, for example, with variations of transducer reactance.

Phase sensitive detector 67, comprised of dual diodes V112 and V113, and time delay circuit 68, comprised of resistor 214 and capacitors 215, are substantially identical in construction and mode of operation to that of phase sensitive detector 65 and time delay circuit 66 and the discussion thereof is equally applicable and for this reason not repeated here. However, due to the fact that the feedback reference signal supplied to the phase sensitive detector 67 is a cosine function whereas the feedback reference signal supplied to the phase sensitive detector 65 is a sine function, the output signal of the phase sensitive detector 67 and time delay circuit 68 is a DC voltage $K_3E'\sin\theta$ and is supplied to the control grid 216 of V103 by conductor 122. The comparison of the feedback reference voltage at 90° with $K_2E'\angle\theta$ in the phase sensitive detector 67 results in an output voltage $K_3E'\sin\theta$ that varies the amplitude of current $I_2\angle 180°$ of current generator 56 in accordance, for example, with variations of transducer resistance.

The AVC circuit 71 is a two-stage amplifier with delayed AVC and is comprised of an input tube V117, gas tube V121 to maintain a constant screen grid potential on V117, output tube V118, diode V119A, and an RC circuit connected to the plate 219 of V119A and to the control grid 190 of V117 and the control grid 221 of V118. The output signal of V118 is applied to the plate 226 of the diode peak detector V119B from the plate 227 of V118 through conductor 228, capacitor 229, and resistor 231. An averaging circuit having a time constant of about 0.2 seconds comprised of a resistor 232 and capacitor 233 is provided connecting the cathode 234 of V119B to the grid 235 of V120A. The DC output signal from the averaging circuit constitutes the input voltage to the trigger circuit 69 which is a bistable flip-flop circuit comprised of V120A and V120B with a relay 73 in the plate circuit of V120A and designed to trigger when its input level changes from, for example, about 17 volts to about 35 volts DC. The AVC amplifier 71 preferably is designed to produce an output of about 25±5 volts rms for a 20 db range of input voltage (0.2–2.0 volts rms). Due to the long time delay of the AVC loop, it takes approximately two seconds for the amplifier to adjust to a step function input. Under normal operating conditions if, for example, the input signal to V117 is one volt rms, the output signal from V118 will be about 20 volts rms and the input to the trigger circuit approximately 17 volts DC. If the input signal to V117 suddenly increases to about 2 volts, the output signal of V118 will suddenly increase to 40 volts rms due to the long time constant in the AVC loop and the input signal to V120A will be about 35 volts DC thereby actuating the trigger circuit and causing the relay 73 to be actuated. However, in approximately 2 seconds, the AVC loop will adjust the bias on V117 and V118 so that the output signal of V118 will again be about 20 volts rms, the input to V120A now being about 17 volts DC thereby causing the trigger circuit to revert to its normal operating condition wherein V120A is cut off and V120B is conducting. In view of the foregoing discussion, it may now be apparent that in order for a step increase in the signal to be applied to the grid 235 of V120A, the signal must have a duration of at least 0.2 seconds and a signal-to-noise ratio of about 6 db. This requirement prevents the trigger circuit 69 from operating on spurious signals of very short duration having a large amplitude and on signals having a sufficient time base but small amplitudes. The trigger circuit 69 may be designed to operate on an ambient signal of 0.2 volts rms and if the ambient level is less than this, the wake signal must be greater than the panel setting in order for the trigger circuit to be actuated.

When the torpedo enters a wake, the initial actuation of V120A locks in relay 73 thereby opening the control solenoid valve 76. The initial actuation of V120A simultaneously actuates relay 89 as more fully described hereinbelow and when the torpedo emerges from the wake the action of the AVC circuit causes the trigger circuit to revert to its normal condition wherein V120A is cut off. When the torpedo re-enters the wake due to the action of the direction selecting means as described hereinbefore, V120A is again caused to conduct thereby causing relay 89 to be thrown to its opposite position and thereby cause the direction of the torpedo to be reversed so that it will again enter the wake. Upon re-entry the procedure as described hereinabove with regard to relay 89 is repeated.

The trigger circuit 69 is a conventional trigger circuit comprised of V120A, V120B, and relay 73 in the plate circuit of V120A. V120A is normally cut off and V120B is normally conducting and maintains the cathode of V120A at a positive potential with respect to its control grid 235. When a signal of sufficient time base is supplied to the control grid 235 of V120A, V120A begins to conduct and V120B is cut off. Conduction of V120A actuates relay 73, the switch 236 in the enabler circuit 17 having previously been closed by operation of the enabler circuit after the torpedo has been launched. Upon actuation of relay 73, contacts 237, 238, 239 and 241 are actuated. Contact 241 removes relay 73 from the plate 242 of V120A and connects it to ground thereby locking it in. Actuation of contact 238 supplies current to the coil 243 of the control solenoid valve and actuates the control solenoid valve 76 to open it. Contact 237 and 239 place coil 244 of relay 89 in series with B+ and the plate 242 of V120A to actuate the direction selecting solenoid valve 77 to the proper position and to render it operative each time the trigger circuit 69 is actuated.

Any suitable transducer that effects a change in impedance when passing through a wake may be used; hence, the method of mounting the transducer need not necessarily be as described herein. As used herein, the term "transducer" is intended to include any device capable of changing acoustical or mechanical wave energy received by it into electrical energy and vice versa.

If desired, the oscillator circuit may be self-tuned to the resonant frequency of the transducer to broaden the permissible limits of operation of the transducer and eliminate the necessity of matching frequencies. Further, fluctuations in total transducer impedance may be balanced out by a single feedback channel by providing manually adjustable means for matching the phase and amplitude of the artificially supplied voltage with the transducer output signal upon installation of the transducer. On the other hand, at the expense of increased complexity, the over-all versatility, dynamic range, and adaptability to other uses may be increased by making the bridge truly, rather than approximately, self-balancing. Such self-balancing may be achieved by dualization of the bridge and a second amplifier channel to provide feedback from a second fixed arm that is not dynamically balanced but that gives an output representative of total actual deviation of instantaneous transducer impedance from a predetermined setting. This feedback may be used, in turn, to balance the first arm of the bridge, the output of which will represent deviation from a running average value.

In conclusion, it will be evident that while the present invention has been described in its preferred embodiment, it is realized that various modification may be made, and it is desired that it be understood that no limitations on the invention are intended other than may be imposed by the scope of the appended claims.

Having now disclosed our invention, what we claim as new and desire to secure by Letters Patent of the United States is:

1. In a torpedo control system the combination comprising: a tuned transducer element for projecting compressional waves of a substantially fixed frequency and having an amplitude-modulated output signal; first means for receiving said amplitude-modulated output signal and having an output signal proportional to fluctuations of transducer impedance; and second means controlled by said first means for guiding the torpedo in a predetermined manner.

2. The combination as described in claim 1 additionally including third means for providing a watertight acoustical path from the water to the transducer element.

3. The combination as described in claim 2 wherein said third means includes a waveguide having an exposed surface flush with the torpedo outer surface and located substantially on the centerline of the torpedo.

4. In a torpedo control system, the combination comprising: a transducer element having appreciably different motional impedance circle characteristics in air and in water for projecting compressional waves of a substantially fixed frequency and having an amplitude-modulated output signal comprised of a carrier signal and a modulation signal; first means for receiving said amplitude-modulated output signal and having an output signal proportional to the fluctuations of transducer impedance about an average value; second means for receiving the output signals of said first means and responsive to output signals of said first means having a time constant greater than a predetermined amount and a signal-to-noise ratio greater than a predetermined amount; and third means controlled by said second means for guiding the torpedo in a predetermined manner.

5. A torpedo control system for controlling the direction of travel of a torpedo wherein the effect of the wake of a moving vessel on the motional impedance of a transducer is the actuating agent comprising: a transducer for projecting compressional waves; first means for supplying a constant current to said transducer at a fixed frequency whereby an amplitude-modulated output signal is developed across said transducer; second means responsive to said amplitude-modulated output signal and having an output signal proportional to transducer impedance fluctuations; and third means actuated by said second means output signal for guiding the torpedo in a predetermined manner.

6. A torpedo control system for controlling the direction of travel of a torpedo wherein the effect of the wake of a moving vessel on the motional impedance characteristic of a transducer is the actuating agent comprising: a transducer for projecting compressional waves; first means for supplying a constant current to said transducer at a fixed frequency whereby an amplitude-modulated output signal is developed across said transducer; second means responsive to said amplitude-modulated output signal for suppressing the carrier signal and having an output signal proportional to transducer impedance fluctuations about an average value; third means responsive to said second means output signals having a time constant greater than a predetermined amount and a signal-to-background ratio greater than a predetermined amount; and fourth means controlled by said third means for causing the torped to follow a predetermined path.

7. The combination as described in claim 6 wherein said second means is comprised of a bridge network having a constant arm and a variable arm, said transducer forming a part of the variable arm; and means for impressing across the constant arm a signal having a phase and amplitude substantially equal to the phase and amplitude of the said transducer carrier signal.

8. The combination as described in claim 7 wherein said second means additionally includes a feedback circuit for controlling the signal impressed across the constant arm of the bridge network whereby variations in said first means output signal having a time constant at least several times greater than the minimum time constant of a signal caused by a wake are substantially suppressed.

9. The combination as described in claim 8 wherein said feedback circuit is comprised of a first portion having an output signal proportional to the cosine of the angle of the output signal of said first means and a second portion having an output signal proportional to the sine of the angle of the output signal of said first means.

10. The combination as described in claim 8 additionally including means for combining with said second means output signal a carrier signal having substantially the same frequency as said first means signal; and wherein said third means is comprised of a detector circuit for receiving said combined signal, a trigger circuit, and a build-up rate measuring circuit whereby said trigger circuit is actuated by said build-up rate measuring circuit only when the output signal of the detector has a time constant greater than a predetermined amount and a signal-to-background ratio greater than a predetermined amount.

* * * * *